US007916837B2

(12) United States Patent
Krzystyniak et al.

(10) Patent No.: US 7,916,837 B2
(45) Date of Patent: Mar. 29, 2011

(54) GRID CONTROL SYSTEM FOR ELIMINATING SOFT RADIATION EMISSIONS FROM AN X-RAY TUBE

(75) Inventors: Roman Krzystyniak, Englewood, CO (US); Pavel Dolgonos, Englewood, CO (US)

(73) Assignee: Core Labs LLC, Englewood, CO (US)

( * ) Notice: Subject to any disclaimer, the term of this patent is extended or adjusted under 35 U.S.C. 154(b) by 0 days.

(21) Appl. No.: 12/803,196

(22) Filed: Jun. 21, 2010

(65) Prior Publication Data

US 2010/0329428 A1 Dec. 30, 2010

Related U.S. Application Data

(63) Continuation of application No. 12/229,041, filed on Aug. 18, 2008, now Pat. No. 7,742,571, which is a continuation of application No. 11/787,642, filed on Apr. 17, 2007, now abandoned.

(60) Provisional application No. 60/792,819, filed on Apr. 17, 2006.

(51) Int. Cl.
*H05G 1/22* (2006.01)
*H05G 1/10* (2006.01)

(52) U.S. Cl. ..... 378/106; 378/101

(58) Field of Classification Search ..... 378/101, 378/106–119
See application file for complete search history.

(56) References Cited

U.S. PATENT DOCUMENTS 5,923,721 A * 7/1999 Duschka ..... 378/92
7,440,547 B2 * 10/2008 Ishiyama ..... 378/101
2006/0280289 A1 * 12/2006 Hanington et al. ..... 378/104

* cited by examiner

*Primary Examiner* — Irakli Kiknadze
(74) *Attorney, Agent, or Firm* — Ramon L. Pizarro; Edwin H. Crabtree

(57) ABSTRACT

A system and method for controlling the radiation emissions from an x-ray tube having an anode, a cathode, and a grid is disclosed. The system and method uses a continuous high voltage across the cathode and the anode of the x-ray tube, so that a high voltage is continuously applied to the x-ray tube between the cathode and the anode. The flow of electrons between the cathode and the anode is then controlled by a pulsed high voltage to the grid, the pulsed high voltage being of substantially the same magnitude as the continuous high voltage and being switched at a frequency of about one micro-second to provide alternate the polarity of the switched high voltage to the grid, so that voltage between the cathode and the anode is switched by the voltage applied to the grid by the source of pulsed high voltage, so that soft radiation emissions from the x-ray tube are minimized or eliminated.

3 Claims, 2 Drawing Sheets

GRID CONTROL SYSTEM FOR ELIMINATING SOFT RADIATION EMISSIONS FROM AN X-RAY TUBE

REFERENCE TO RELATED APPLICATIONS

This application is a continuation of my application having Ser. No. 12/229,041, filed Aug. 18, 2008, now U.S. Pat. No. 7,742,571, incorporated herein by reference in its entirety, which is a continuation of my application having Ser. No. 11/787,642, filed on Apr. 17, 2007, now abandoned which claims the benefit of my provisional application having Ser. No. 60/792,819, filed Apr. 17, 2006.

BACKGROUND OF THE INVENTION (a) Field of the Invention

This invention generally relates to a method or system for controlling the grid on an X-ray tube in order to reduce the amount of soft radiation emitted.

(b) Discussion of Known Art

When an X-ray tube is being used for certain applications, the X-ray tube is operated in relatively short bursts at a relatively high frequency in order to obtain clear images. Typically, the tube is operated at approximately 4-6 ms bursts. This relatively small X-ray tube current produced with pulsed fluroscopy does not sufficiently discharge the capacitance of the high-voltage cables connecting the power supply and X-ray tube between exposure frames. Accordingly, the pulse waves do not have sharp "square" shape, but produce a "tail" of output after the desired peak of the burst has been reached. The "tail" on the power supply output waveform produces unwanted soft radiation that adds to the patient dose and does not improve the image. It would thus be desirable to provide a high-voltage power supply for an X-ray tube that produced substantially rectangular waveforms without a trailing tail of unwanted soft radiation.

SUMMARY

Energy supplied to an X-Ray tube comes from a power supply (Generator) designed to take in line voltage and supply and X-Ray tube with the power it needs. During long medical procedures (such as Electro Physiology for example) physicians currently use "continuous" or "pulse fluoroscopy". When a patient is X-Rayed, an image is produced. When the same patient is X-Rayed with higher power supplied to the tube, more radiation is emitted (which is bad for the patient), but image quality is better. Simply put, when the power and thus radiation is increased, image quality is improved. Current technology such as pulse fluoroscopy reduces radiation dose to the patient while maintaining identical or superior image quality. It does so by the following method.

Typically, X-Ray systems use 1 to 30 pulses per second, duration of each pulse lasts between 4 and 6 milliseconds. In current technology pulse fluoroscopy, mode X-Ray generators pulse the high voltage (KVp) to the tube, while controlling the tube current (mA) using a tube filament. Due to the capacitance of high voltage cables used in X-Ray systems, KVp waveform has a short (1.5 to 2.5 mS) rise time, but a long fall time (about 10 ms at 25 mA of tube current). During rise and fall times, an X-Ray tube emits "soft radiation" which absorbed by the patient but does not contribute anything to the image quality. Further, the high voltage cable capacitance gets charged each and every time, when high voltage is turned on, and subsequently discharges each and every time, at the end of each pulse, dumping all energy stored in the system into the X-Ray tube causing unnecessary tube heating. Unnecessary tube heating will shorten a tubes life.

The power supply (generator) disclosed here, will use a grid control system (dubbed "Modulated" Pulse Fluoroscopy) instead of current technology, which pulses high voltage. In such a grid control system, high voltage will be continuously applied to the tube, but the tube current will be switched on and off by applying negative voltage to the grid. The rise and fall time of radiation while using grid control will only be a couple of microseconds, instead of milliseconds. Also power demand from the generator and heat dissipated by the tube will be significantly reduced (up to 70%) because high voltage cables will stay charged during whole exposure time. "Soft radiation" caused by slow rise and fall time of high voltage will be eliminated.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
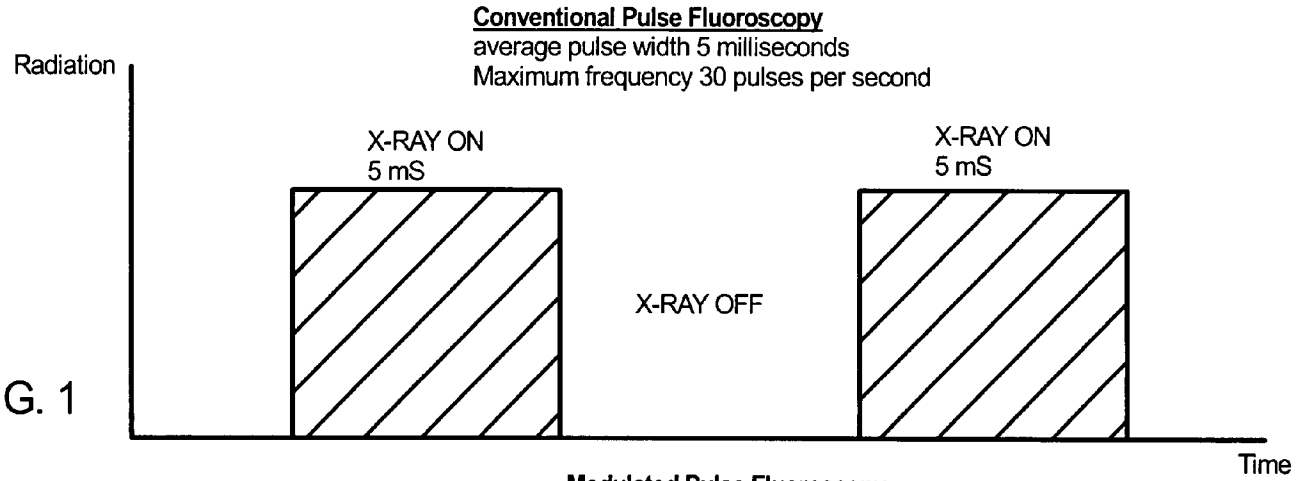
FIG. 1 is a time diagram of the formation of pulses used in known systems of pulse fluoroscopy.

Turning now to FIG. 1 where the known pulsed fluoroscopy grid voltage actuation is typically activated in 5 ms bursts, with a period of at least 5 ms between each burst. As explained above, these periods of theoretical zero voltage are responsible for the emission of soft radiation due to the fact that the voltage does not truly drop to zero as desired.

Figure 2:
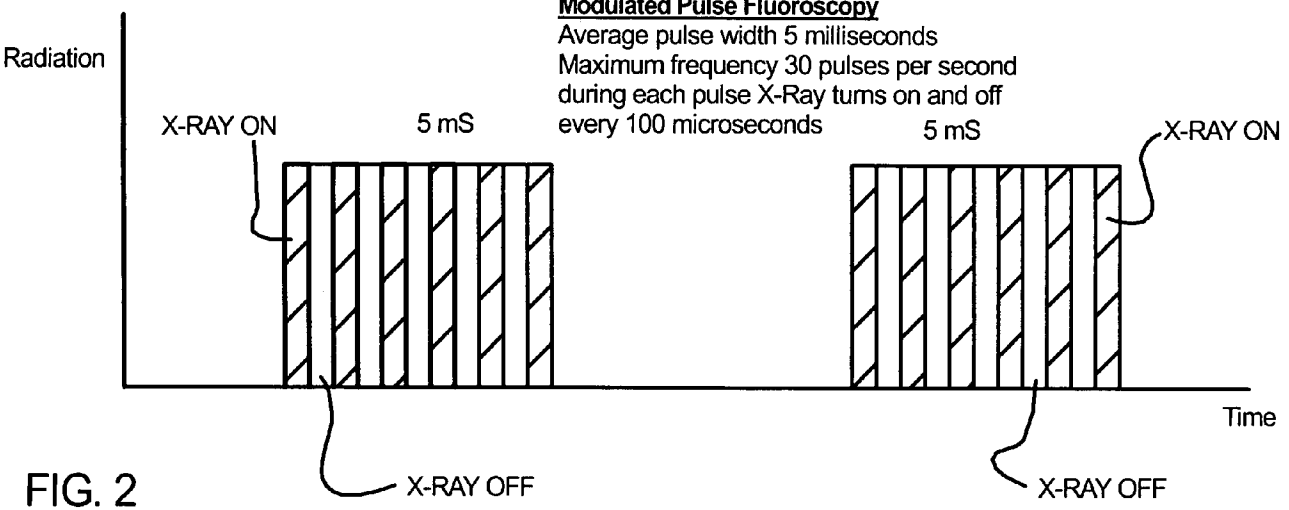
FIG. 2 is a time diagram of the formation of pulses used with the disclosed system and method of modulated pulse fluoroscopy.
Figure 3:
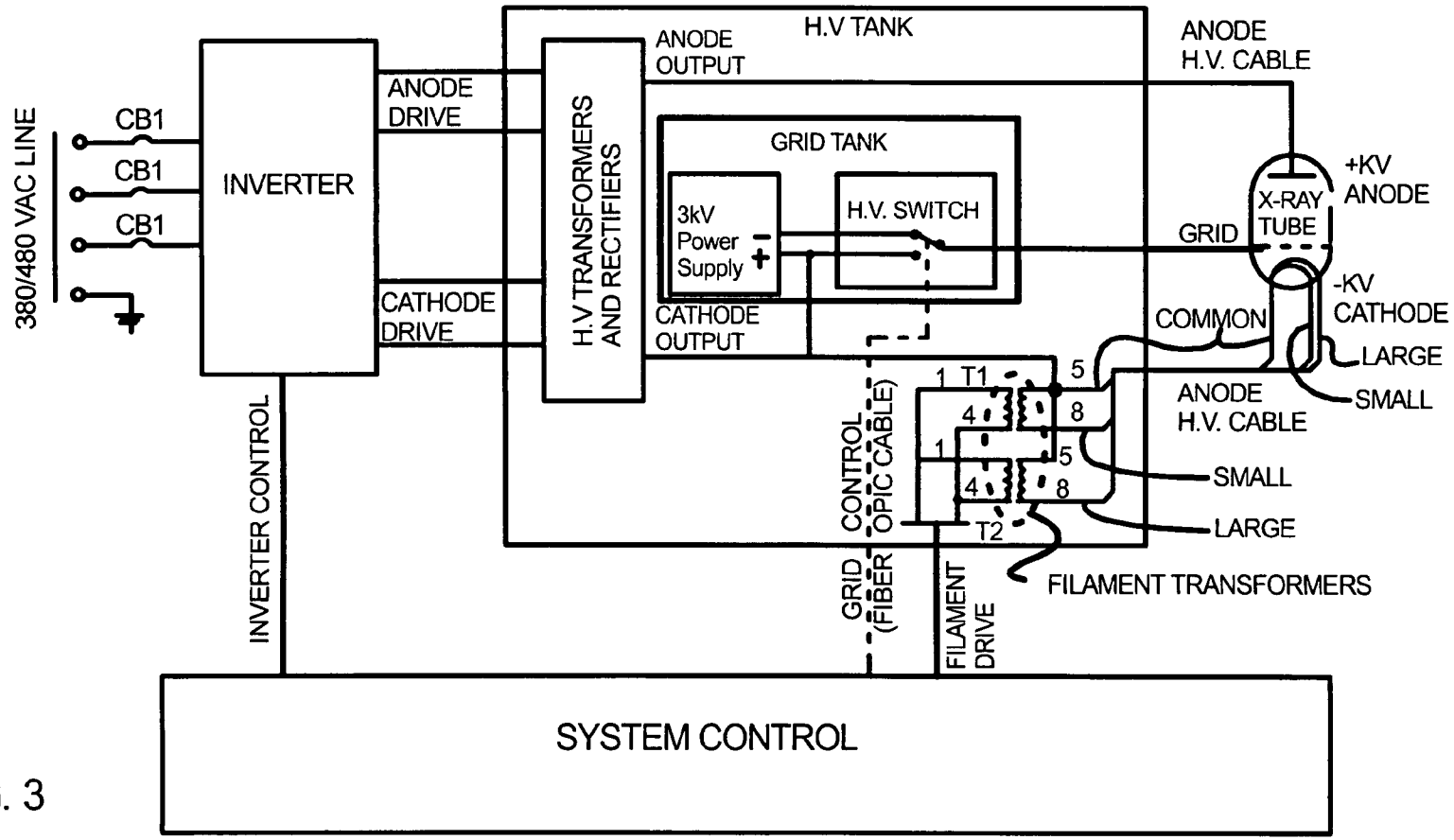
FIG. 3 illustrates the circuitry used to create the pulses as shown in FIG. 2.

It has been discovered that forming the 5 ms burst from a multitude of much smaller bursts with the same voltage amplitude as used with known systems eliminates the tail, and thus the soft radiation that is produced through conventional methods. In FIG. 2, it is shown that the use of 100 microsecond bursts for a five-millisecond duration will produce the same image quality while greatly diminishing or eliminating soft radiation.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A method for controlling an x-ray beam generated by an x-ray source in a fluoroscope, the fluoroscope comprising an x-ray receiver disposed opposite the x-ray source, and a grid disposed between a cathode and an anode of the X-ray source, the method comprising:

generating a first pulsed fluoroscopic signal having a first plurality of pulses at a first pulse rate;

based on the first pulsed fluoroscopic signal, generating a second pulsed fluoroscopic signal, wherein for each of the first plurality of pulses, a second plurality of pulses is generated at a second pulse rate higher than the first pulse rate; and driving voltage of the grid using the second pulsed fluoroscopic signal, wherein the second pulsed fluoroscopic signal is communicated to the grid to cause the X-ray beam to pulse on and off in accordance with the second pulsed fluoroscopic signal during imaging.

2. A method as recited in claim 1 wherein generating the second pulsed fluoroscopic signal comprises replacing each of the first plurality of pulses with a second plurality of pulses at the second pulse rate.

3. A method as recited in claim 1 wherein driving voltage of the grid comprises: receiving high power voltage from a high power voltage source; and modulating the high power voltage with the second pulsed fluoroscopic signal.

* * * * *